US010196856B2

(12) United States Patent
Desfossez et al.

(10) Patent No.: US 10,196,856 B2
(45) Date of Patent: Feb. 5, 2019

(54) METHOD FOR CONFIGURING A MOTORISED DRIVE DEVICE FOR A HOME AUTOMATION UNIT, AND ASSOCIATED UNIT AND MOTORISED DRIVE DEVICE

(71) Applicant: SOMFY ACTIVITES SA, Cluses (FR)

(72) Inventors: Benjamin Desfossez, Cluses (FR); Cyril Rieu, Marnaz (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 15/571,138

(22) PCT Filed: May 3, 2016

(86) PCT No.: PCT/EP2016/059903
§ 371 (c)(1),
(2) Date: Nov. 1, 2017

(87) PCT Pub. No.: WO2016/177737
PCT Pub. Date: Nov. 10, 2016

(65) Prior Publication Data

US 2018/0171712 A1 Jun. 21, 2018

(30) Foreign Application Priority Data

May 4, 2015 (FR) ..... 15 53978

(51) Int. Cl.
*E06B 9/40* (2006.01)
*E06B 9/72* (2006.01)
(Continued)

(52) U.S. Cl.
CPC ..... *E06B 9/72* (2013.01); *E06B 9/40* (2013.01); *E06B 9/68* (2013.01); *E06B 9/88* (2013.01)

(58) Field of Classification Search
CPC ..... E06B 9/72; E06B 9/88; E06B 9/40
See application file for complete search history.

(56) References Cited

U.S. PATENT DOCUMENTS 7,923,948 B2 * 4/2011 Rodas ..... E06B 9/322 318/266
8,008,883 B2 * 8/2011 Hoff ..... E04F 10/0651 160/7

(Continued)

FOREIGN PATENT DOCUMENTS

EP 2 148 036 A1 1/2010
FR 2 849 300 A1 6/2004

OTHER PUBLICATIONS

International Search Report, dated Jul. 18, 2016, from corresponding PCT/EP2016/059903 application.

*Primary Examiner* — Katherine W Mitchell
*Assistant Examiner* — Abe Massad
(74) *Attorney, Agent, or Firm* — Young & Thompson

(57) ABSTRACT

A method for configuring a motorized drive device for a closure or solar protection unit including: placing of the motorized drive device in a configuration mode; first movement of a screen towards its unwound position, by activation of the motorized drive device; automatic determination of a low end-of-travel position of the screen; movement of the screen towards its wound position, by activation of the motorized drive device; second movement of the screen towards its unwound position, by activation of the motorized drive device; and stopping of the motorized drive device at the low end-of-travel position of the screen determined during the automatic determination step. The step including the automatic determination of the low end-of-travel position of the screen includes a sub-step for measuring the value of the electric current passing through the electric motor, performed by the measurement device, and a sub-step for determining a variation in the measured value.

9 Claims, 4 Drawing Sheets

(51) Int. Cl.
*E06B 9/68* (2006.01)
*E06B 9/88* (2006.01)

(56) References Cited

U.S. PATENT DOCUMENTS

| | | | | |
|---|---|---|---|---|
| 8,604,736 | B2 * | 12/2013 | Grehant | E06B 9/88 318/280 |
| 8,692,498 | B2 * | 4/2014 | Feldstein | E06B 9/42 318/470 |
| 9,534,442 | B2 * | 1/2017 | Derk, Jr. | E06B 9/72 |
| 2014/0090787 | A1 * | 4/2014 | Colson | E06B 9/82 160/7 |
| 2014/0224437 | A1 * | 8/2014 | Colson | E06B 9/42 160/291 |
| 2014/0290870 | A1 * | 10/2014 | Colson | E06B 9/42 160/10 |
| 2016/0376843 | A1 * | 12/2016 | Schneider | E06B 9/11 318/16 |

* cited by examiner

METHOD FOR CONFIGURING A MOTORISED DRIVE DEVICE FOR A HOME AUTOMATION UNIT, AND ASSOCIATED UNIT AND MOTORISED DRIVE DEVICE

The present invention relates to a method for configuring a motorized drive device for a closure or sun-protection home-automation installation, a motorized drive device of a closure or sun-protection home-automation installation, and a closure or sun-protection home-automation installation incorporating such a motorized drive device.

In general, the present invention relates to the field of concealment devices comprising a motorized drive device setting a screen in motion between at least one first position and one second position.

BACKGROUND OF THE INVENTION

A motorized drive device comprises an electromechanical actuator for a movable element for closing, concealing or providing sun protection such as a blind or any other equivalent material, hereinafter referred to as a screen.

Motorized drive devices for a closure or sun-protection home-automation installation are known. Such home-automation installations comprise a concealing device. The concealing device comprises a winding tube, a screen and a load bar. A first end of the screen is fastened to the winding tube. Additionally, a second end of the screen is fastened to the load bar.

The motorized drive device comprises an electromechanical actuator making it possible to wind and unwind the screen on the winding tube, between a wound position and an unwound position. The electromechanical actuator comprises an electric motor, an output shaft connected to the winding tube of the concealing device and an electronic control unit.

The electronic control unit comprises a device for measuring the rotation speed of a rotor of the electric motor.

When configuring the motorized drive device, the electronic control unit of the electromechanical actuator carries out a step for automatically determining end-of-travel positions of the screen.

The automatic determination of the end-of-travel positions of the screen is carried out by analyzing the variation in the rotation speed of the rotor of the electric motor of the electromechanical actuator.

The motorized drive device can operate in a control mode and in a configuration mode.

Before the step for automatically determining the low end-of-travel position of the screen, a step for entering the configuration mode is carried out.

The entry in the configuration mode of the motorized drive device may be implemented by pressing on a programming selection element of a control point or by simultaneous pressing on two selection elements of the control point, the two selection elements of the control point being the raising and lowering keys of the screen.

After entering the configuration mode of the motorized drive device is implemented, a step for moving the screen toward the unwound position is carried out by activating the motorized drive device. The motorized drive device is activated by pressing the lowering key of the screen.

Once the low end-of-travel position of the screen is determined by the electronic control unit of the electromechanical actuator, the motorized drive device is stopped.

Nevertheless, between the moment at which the low end-of-travel position of the screen is determined and the moment at which the motorized drive device is stopped, the electromechanical actuator drives the winding tube in a movement lowering the screen.

In order to offset the reaction time of the motorized drive device following the determination of the low end-of-travel position of the screen, the motorized drive device is activated in the opposite direction to move the screen toward the wound position and stopped again.

The movement of the screen toward the wound position is implemented so as to reach a position higher than the position reached during the determination of the low end-of-travel position, in which the load bar of the screen does not rest on a threshold of an opening equipped with the screen belonging to the concealing device and where the screen is kept stretched.

The position higher than the position reached during the determination of the low end-of-travel position is a learning position and is determined as being a reference position to validate the low end-of-travel position of the screen.

However, the configuration of these motorized drive devices has the drawback of validating the learning position after a final upward movement of the screen, whereas, in the control mode of the motorized drive device, the reaching of the lower end-of-travel position is determined during a lowering movement of the screen.

Consequently, the learning position in the configuration mode is different from the low end-of-travel position of the screen reached in the control mode, since the learning position in the configuration mode is reached after an upward movement of the screen and the low end-of-travel position of the screen in the control mode is reached following a lowering movement of the screen.

Furthermore, to verify the learning position determined in the configuration mode of the motorized drive device, the installer performs a lowering movement of the screen toward the unwound position in the control mode of the motorized drive device.

In this way, the installer verifies that the low end-of-travel position reached in the control mode is correct, i.e. that, on the one hand, the screen is kept stretched, in other words the load bar of the screen is not resting on the threshold of the opening, and on the other hand, the load bar of the screen is not too far from the threshold of the opening.

Document EP 2,148,036 A1 is also known, which describes a closure home-automation installation comprising a rolling shutter, a motorized drive device and a control device. The rolling shutter comprises a winding tube and an apron. A first end of the apron is connected to the winding tube and a second end of the apron comprises a final end slat. The motorized drive device comprises an electromechanical actuator making it possible to wind and unwind the apron on the winding tube, between a wound position and an unwound position. The electromechanical actuator comprises an electric motor, an output shaft connected to the winding tube and an electronic control unit. The control device comprises two control keys, one of which makes it possible to command an upward movement of the apron and the other of which makes it possible to command a downward movement of the apron. The configuration of the rolling shutter is carried out by entering a configuration mode, then performing a first movement of the apron toward the unwound position by activating the lowering control key, a movement of the apron toward the wound position by activating the raising control key of the apron, a second movement of the apron toward the unwound position by activating the lowering control key and stopping the motorized drive device at a low end-of-travel position of the apron determined by the change in movement direction of the apron between the first movement of the apron toward the unwound position and the movement of the apron toward the wound position.

SUMMARY OF THE INVENTION

The present invention aims to resolve the aforementioned drawbacks and to propose a method for configuring a motorized drive device for a closure or sun-protection home-automation installation, an associated motorized drive device and a closure or sun-protection home-automation installation comprising such a motorized drive device, making it possible to improve the learning precision of the low end-of-travel position of the screen.

To that end and according to a first aspect, the present invention relates to a method for configuring a motorized drive device for a closure or sun-protection home-automation installation,

- the closure or sun-protection home-automation installation comprising a concealing device,
- the concealing device comprising at least:
  - a winding tube,
  - a screen, a first end of the screen being fastened to the winding tube, and
  - a load bar, a second end of the screen being fastened to the load bar,
- the motorized drive device comprising at least:
  - an electromechanical actuator making it possible to wind and unwind the screen on the winding tube, between a wound position and an unwound position,
- the electromechanical actuator comprising at least:
  - an electric motor,
  - an output shaft connected to the winding tube of the concealing device, and
  - an electronic control unit,
- the electronic control unit comprising at least:
  - a device for measuring a parameter of an electric current traversing the electric motor, and
  - a memory storing a value of the measured parameter.

The configuration method comprises at least the following steps:

- entering a configuration mode of the motorized drive device,
- first movement of the screen toward the unwound position by activating the motorized drive device,
- automatically determining a low end-of-travel position of the screen,
- moving the screen toward the wound position by activating the motorized drive device.

According to the invention, the configuration method comprises at least the following steps:

- second movement of the screen toward the unwound position by activating the motorized drive device,
- stopping the motorized drive device in the determined low end-of-travel position of the screen, during the automatic determination step.

Furthermore, the step for automatically determining the low end-of-travel position of the screen comprises a sub-step for measuring the parameter of the electric current traversing the electric motor using the measuring device and a sub-step for determining a variation of the measured parameter.

Thus, the method for configuring the motorized drive device of the closure or sun-protection home-automation installation makes it possible, in the configuration mode of the motorized drive device, to learn the low end-of-travel position of the screen following a downward movement of the screen, like upon reaching the low end-of-travel position of the screen in a control mode of the motorized drive device, so as to minimize the distance between the learning position defined in the configuration mode and the low end-of-travel position of the screen reached in the control mode.

In this way, the method for configuring the motorized drive device for the closure or sun-protection home-automation installation makes it possible to improve the learning precision of the low end-of-travel position of the screen.

Furthermore, such a method for configuring the motorized drive device makes it possible to eliminate the verification by the installer of the low end-of-travel position of the screen reached in the control mode relative to the learning position defined in the configuration mode.

Advantageously, the electronic control unit comprises at least one device for measuring a parameter of an electric current traversing the electric motor and a memory storing a value of the measured parameter.

According to one preferred feature of the invention, the configuration method comprises, following the step for determining the low end-of-travel position of the screen, a step for validating the low end-of-travel position of the screen.

Advantageously, the step for validating the low end-of-travel position of the screen is carried out when the determined variation of the measured parameter, during the sub-step, is above a predetermined threshold value.

Preferably, the step for validating the determined low end-of-travel position of the screen comprises a sub-step for activating the motorized drive device, so as to move the screen toward the unwound position, during a predetermined period of time.

In practice, the step for moving the screen toward the wound position by activating the motorized drive device is carried out during the predetermined period of time or during at least a predetermined portion of a revolution of the output shaft of the electromechanical actuator.

Preferably, the step for automatically determining the low end-of-travel position of the screen comprises a sub-step for storing the low end-of-travel position of the screen.

Advantageously, the configuration method comprises, following the step for stopping the motorized drive device in the determined low end-of-travel position of the screen, a step for confirming the low end-of-travel position of the screen.

According to a second aspect, the present invention relates to a motorized drive device for a closure or sun-protection home-automation installation. This motorized drive device comprises the electronic control unit of the electromechanical actuator configured to carry out the method for configuring the motorized drive device.

This motor-driven drive device has features and advantages similar to those previously described relative to the configuration method according to the invention.

According to a third aspect, the present invention relates to a closure or sun-protection home-automation installation comprising a motorized drive device as set out above.

The invention also pertains to a data recording medium, readable by a computer, on which a computer program is saved comprising computer code program information to carry out the steps of the configuration method previously defined.

The invention also pertains to a computer program comprising computer program code means suitable for carrying out the steps of the configuration method previously defined, when the program is run by a computer.

BRIEF DESCRIPTION OF THE DRAWING

Other particularities and advantages of the invention will also appear in the description below.

In the appended drawings, provided as non-limiting examples.

DETAILED DESCRIPTION OF THE PREFERRED EMBODIMENTS

Figure 1:
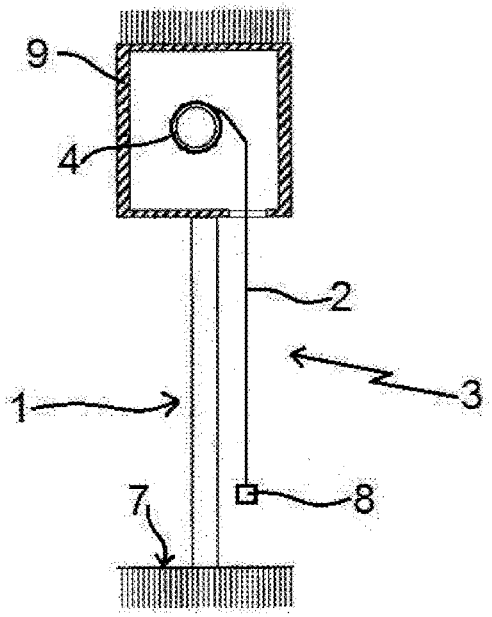
FIG. 1 is a cross-sectional schematic view of a home-automation installation according to one embodiment of the invention.
Figure 2:
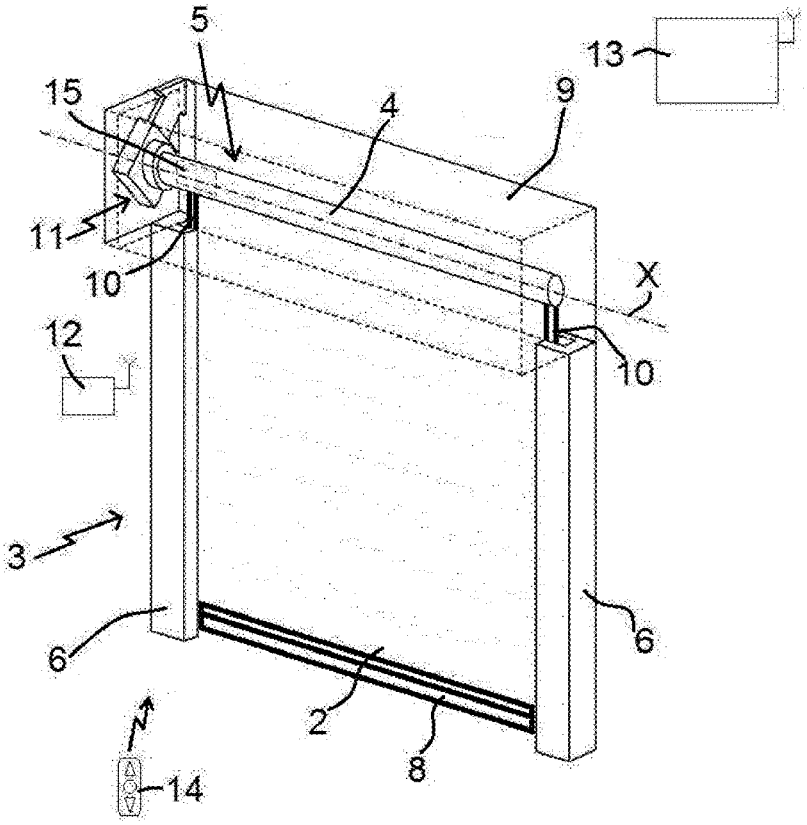
FIG. 2 is a schematic perspective view of the home-automation installation illustrated in FIG. 1.

In reference to FIGS. 1 and 2, we will first describe a home-automation installation according to the invention and installed in a building comprising an opening 1, window or door, equipped with a screen 2 belonging to a concealing device 3, in particular a motorized windable blind.

The concealing device 3 is a fabric blind.

A windable blind according to one embodiment of the invention will be described in reference to FIGS. 1 and 2.

The screen 2 of the concealing device 3 is wound on a winding tube 4 driven by a motorized drive device 5 and movable between a wound position, in particular an upper position, and an unwound position, in particular a lower position.

The moving screen 2 of the concealing device 3 is a closing, concealing and/or sun-protection screen, winding on the winding tube 4, the inner diameter of which is substantially equivalent to the outer diameter of an electromechanical actuator 11, such that the electromechanical actuator 11 can be inserted into the winding tube 4 during the assembly of the concealing device 3.

The motorized drive device 5 comprises the electromechanical actuator 11, in particular of the tubular type, making it possible to set the winding tube 4 in rotation so as to unwind or wind the screen 2 of the concealing device 3.

The concealing device 3 comprises the winding tube 4 for winding the screen 2, where, in the mounted state, the electromechanical actuator 11 is inserted into the winding tube 4.

The concealing device 3 also comprises a load bar 8 for exerting tension on the screen 2.

In a known manner, the windable blind, which forms the concealing device 3, includes a fabric, forming the screen 2 of the windable blind 3. A first end of the screen 2, in particular the upper end of the screen 2 in the assembled configuration of the concealing device 3 in the home-automation installation, is fastened to the winding tube 4. Additionally, a second end of the screen 2, in particular the lower end of the screen 2 in the assembled configuration of the concealing device 3 in the home-automation installation, is fastened to the load bar 8.

Here, the fabric forming the screen 2 is made from a textile material. Furthermore, such a fabric forming the screen 2 can be provided to be impermeable to air, in other words wind-resistant.

In an example embodiment that is not shown, the first end of the screen 2 has an eyelet through which a rod is positioned, in particular made from plastic. This eyelet made at the first end of the screen 2 is obtained using a seam of the fabric forming the screen 2. During the assembly of the screen 2 on the winding tube 4, the eyelet and the rod situated at the first end of the screen 2 are inserted by sliding in a slot arranged on the outer face of the winding tube 4, in particular over the entire length of the winding tube 4, so as to be able to wind and unwind the screen 2 around the winding tube 4.

In the case of a windable blind, the upper wound position corresponds to the bearing of the load bar 8 of the screen 2 against an edge of a box 9 of the windable blind 3, and the lower unwound position corresponds to the bearing of the load bar 8 of the screen 2 against a threshold 7 of the opening 1.

The winding tube 4 is positioned inside the box 9 of the windable blind 3. The screen 2 of the windable blind 3 winds and unwinds around the winding tube 4 and is housed at least partially inside the box 9.

In general, the box 9 is positioned above the opening 1, or in the upper part of the opening 1.

In the embodiment illustrated in FIG. 2, the screen 2 also includes, at each of its lateral edges, a fastening part 10 in the form of a strip. The home-automation installation comprises two lateral guideways 6 positioned along two lateral edges of the opening 1. The lateral guideways 6 additionally respectively comprise a groove inside which a fastening part 10 of the screen 2 is retained, as well as a lateral end of the load bar 8 fastened to the second end of the screen 2.

Thus, during the winding or unwinding of the screen 2, the fastening parts 10 fastened on the lateral edges of the screen 2 and the lateral ends of the load bar 8 fastened to the second end of the screen 2 are retained in the lateral guideways 6, so as to guarantee lateral guidance of the screen 2.

Each groove arranged in a lateral guideway 6 makes it possible to prevent the withdrawal of a fastening part 10 fixed on one of the lateral edges of the screen 2, during the movement of the screen 2 between the wound position and the unwound position.

Preferably, each fastening part 10 extends along the entire length of one of the two lateral edges of the screen 2.

In one example embodiment, the fastening parts 10 are respectively fastened at a lateral edge of the screen 2 by gluing, welding or overmolding. Additionally, the fastening parts 10 can be made from plastic, and in particular, overmolded on the lateral edges of the screen 2.

Here, the lateral guideways 6 respectively positioned along a lateral edge of the opening 1 extend along a vertical direction. The lateral guideways 6 extend from the threshold 7 of the opening 1 to the box 9 of the windable blind 3.

Advantageously, trim elements, not shown, are positioned inside lateral guideways 6 and cooperate with the fastening parts 10 respectively fastened at a lateral edge of the screen 2, so as to keep the screen 2 stretched by applying a force on each fastening part 10 against a wall of the lateral guideway 6.

For example and non-limitingly, the trim elements positioned inside the lateral guideways 6 are provided with elastics, in particular made from plastic. The trim elements can also be provided in the form of foam or include a fly.

Thus, the trim elements positioned inside the lateral guideways 6 make it possible to guarantee the application of a frictional resistance on the fastening parts 10 of the screen 2, so as to keep the screen 2 stretched, during a movement of the screen 2 or when the screen 2 is kept stopped.

Advantageously, the box 9 of the blind 3 and the side guideways 6 form a frame inside which the screen 2 can be moved. This frame can be closed by an additional bar connecting the two lateral guideways 6 at the threshold 7 of the opening 1.

The motorized drive device 5 is controlled by a control unit. The control unit may for example be a local control unit 12, where the local control unit 12 can be connected through a wired or wireless connection with a central control unit 13. The central control unit 13 drives the local control unit 12, as well as other similar local control units distributed throughout the building.

The central control unit 13 can be in communication with a weather station located outside the building, in particular including one or more sensors that can be configured for example to determine a temperature, brightness, or wind speed.

A remote control 14, which can be a type of local control unit, and provided with a control keypad, which comprises selection and display means, further allows a user to intervene on the electromechanical actuator 11 and/or the central control unit 13.

The motorized drive device 5 is preferably configured to carry out the unwinding or winding commands of the screen 2 of the concealing device 3, which may in particular be acquired by the remote control 14.

The electromechanical actuator 11 comprises an electric motor 16. The electric motor 16 comprises a rotor and a stator, not shown and positioned coaxially around a rotation axis X, which is also the rotation axis of the winding tube 4 in the assembled configuration of the motorized drive device 5.

Control means for controlling the electromechanical actuator 11, in accordance with the invention, making it possible to move the screen 2 of the concealing device 3, comprise at least one electronic control unit 15. This electronic control unit 15 is able to operate the electric motor 16 of the electromechanical actuator 11, and in particular to allow the supply of electricity for the electric motor 16.

Thus, the electronic control unit 15 in particular controls the electric motor 16, so as to open or close the screen 2, as previously described.

The electronic control unit 15 also comprises an order receiving module, in particular for wireless orders sent by an order transmitter, such as the remote control 14 designed to control the electromechanical actuator 11 or one of the local 12 or central 13 control units.

The order receiving module can also allow the reception of orders sent by wired means.

Figure 3:
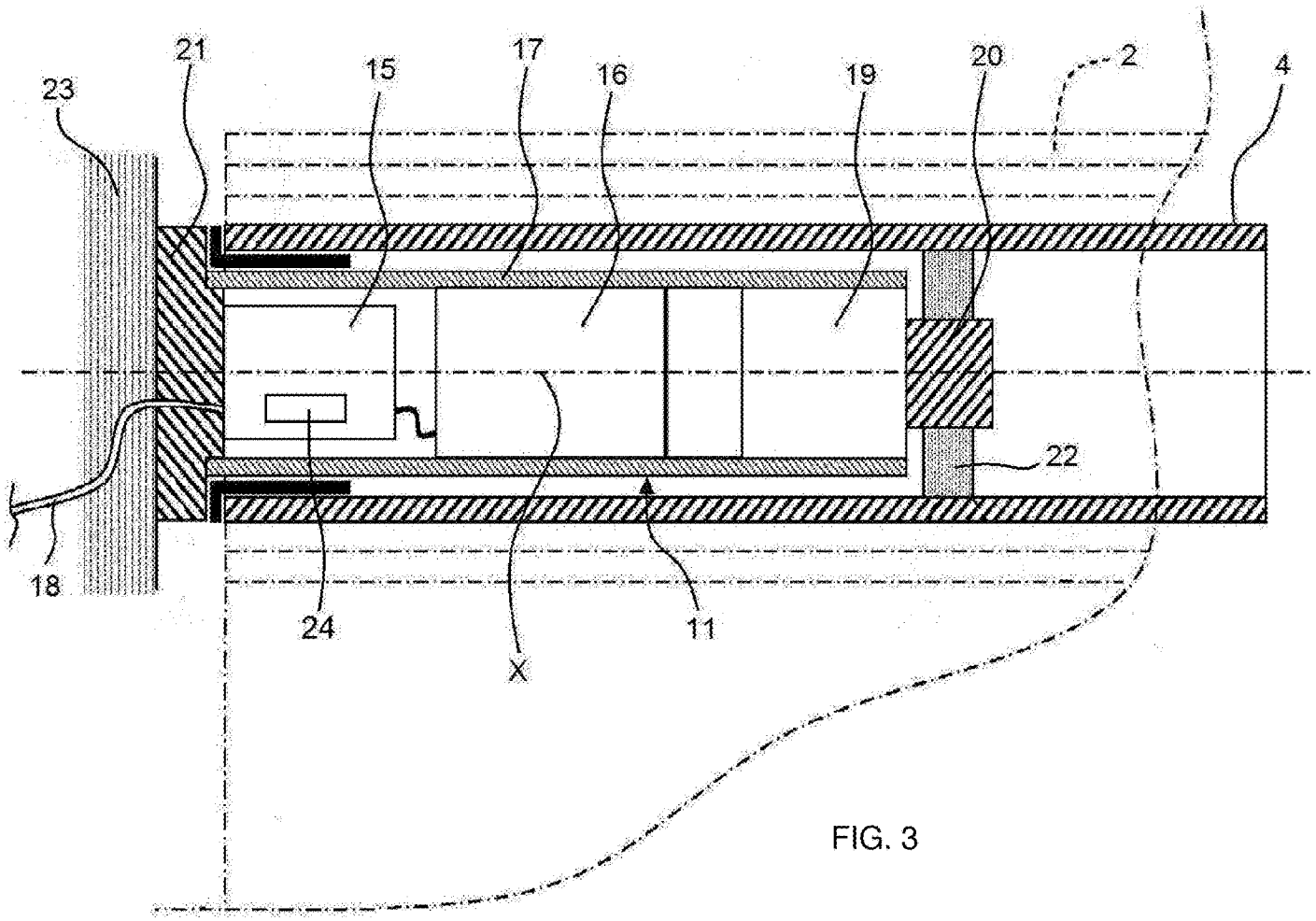
FIG. 3 is a schematic partial sectional view of the home-automation installation illustrated in FIG. 2 comprising an electromechanical actuator according to one embodiment of the invention.

Here, and as illustrated in FIG. 3, the electronic control unit 15 is positioned inside a casing 17 of the electromechanical actuator 11.

The control means of the electromechanical actuator 11 comprise hardware and/or software means.

As one non-limiting example, the hardware means may comprise at least one microcontroller.

The electromechanical actuator 11 belonging to the home-automation installation of FIGS. 1 and 2 will now be described in reference to FIG. 3.

The electromechanical actuator 11 is supplied with electricity by an electricity grid of the sector, or using a battery, which can for example be recharged by a photovoltaic panel. The electromechanical actuator 11 makes it possible to move the screen 2 of the concealing device 3.

Here, the electromechanical actuator 11 comprises a power supply cable 18 making it possible to supply electricity from the electricity grid of the sector.

The casing 17 of the electromechanical actuator 11 is preferably cylindrical.

In one embodiment, the casing 17 is made from a metal material. The material of the electromechanical actuator is in no way limiting and may be different, and in particular made from plastic.

The electromechanical actuator 11 also comprises a reducing gear device 19 and an output shaft 20.

Advantageously, the electric motor 16 and the reducing gear device 19 are positioned inside the casing 17 of the electromechanical actuator 11.

The output shaft 20 of the electromechanical actuator 11 is positioned inside the winding tube 4, and at least partially outside the casing 17 of the electromechanical actuator 11.

The output shaft 20 of the electromechanical actuator 11 is coupled by a connecting means 22 to the winding tube 4, in particular using a wheel-shaped connecting means.

The electromechanical actuator 11 also comprises a sealing element 21 for one end of the casing 17.

Here, the casing 17 of the electromechanical actuator 11 is fastened to a support 23, in particular a flange, of the box 9 of the concealing device 3 using the closing off element 21 forming a torque pin, in particular a closing off and torque-reacting head. In such a casing where the closing off element 21 forms a torque pin, the closing off element 21 is also called a fixed point of the electromechanical actuator 11.

The electronic control unit 15 of the electromechanical actuator 11 comprises a device for detecting obstacles and ends of travel during winding of the screen 2 and during unwinding of said screen 2.

The device for detecting obstacles and ends of travel during winding and unwinding of the screen 2 is implemented using a microcontroller of the electronic control unit 15, and in particular using an algorithm implemented by this microcontroller.

The electronic control unit 15 comprises a device 24 for measuring a parameter T of an electric current traversing the electric motor 16 and a memory storing a value of the measured parameter T.

In one embodiment, the parameter T of the electric current traversing the electric motor 16 measured by the measuring device 24 is a voltage, and in particular, a voltage across the terminals of a phase shift capacitor of the electric motor 16 of the electromechanical actuator 11. The measurement of the voltage across the terminals of the phase shift capacitor of the electric motor of the electromechanical actuator is well known in the state of the art and is described, in particular, in document FR 2,849,300 A1.

The acquisition of the voltage traversing the electric motor 16 via the measuring device 24 makes it possible to obtain a signal representative of the torque generated by the electric motor 16 of the electromechanical actuator 11.

Here, the memory storing the parameter T of the electric current traversing the electric motor 16 is made up by a memory of a microcontroller of the electronic control unit 15, in particular a memory of the EEPROM (Electrically Erasable Programmable Read Only Memory) type.

The motorized drive device 5 is provided to operate at least in a control mode and a configuration mode.

Figure 4:
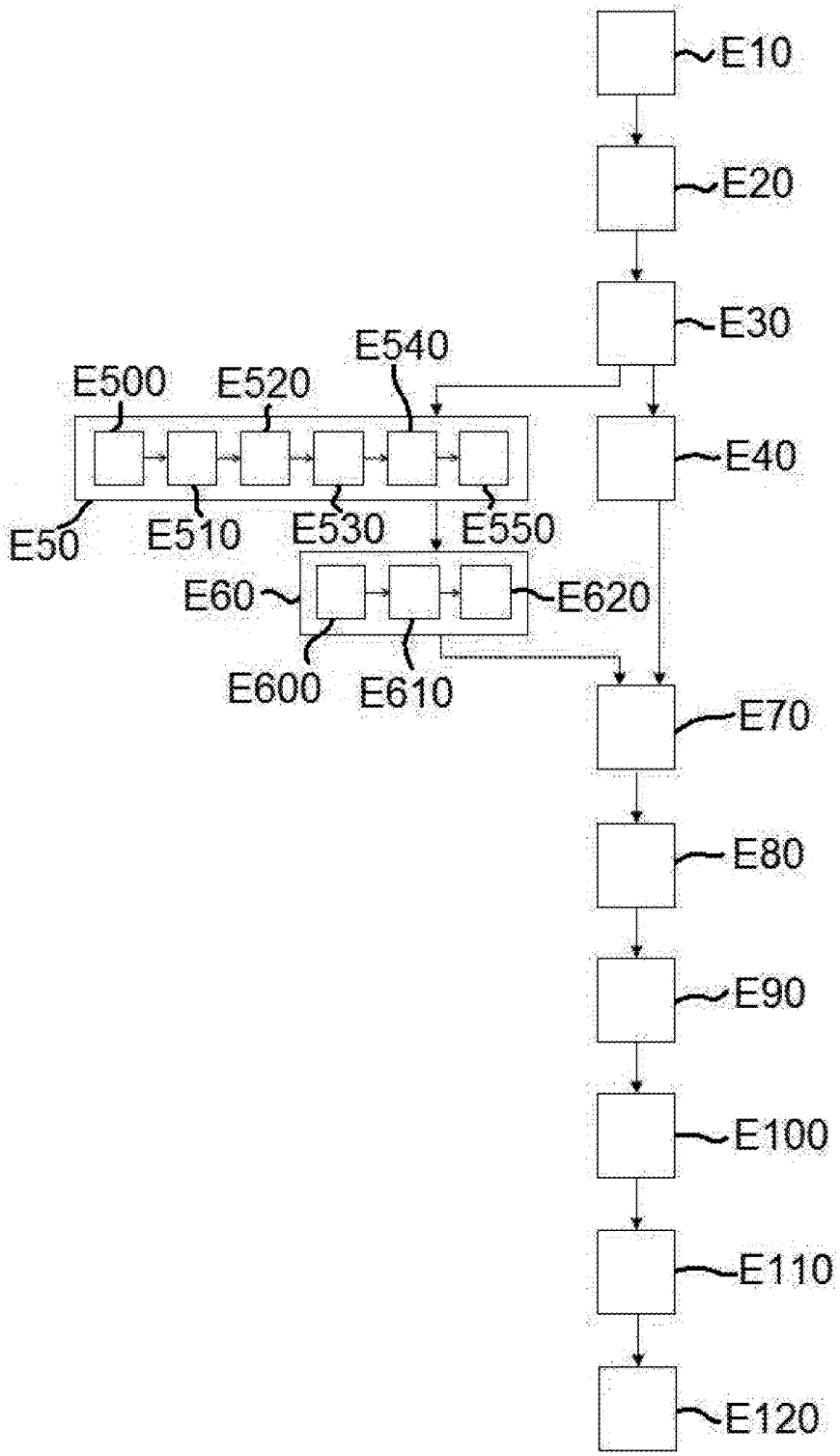
FIG. 4 is a block diagram of an algorithm of a method according to the invention, for configuring a motorized drive device of a home-automation installation illustrated in FIGS. 1 to 3.

In reference to FIG. 4, we will now describe one embodiment of a method for configuring the motorized drive device 5 of the home-automation installation illustrated in FIGS. 1 to 3.

Figure 5:
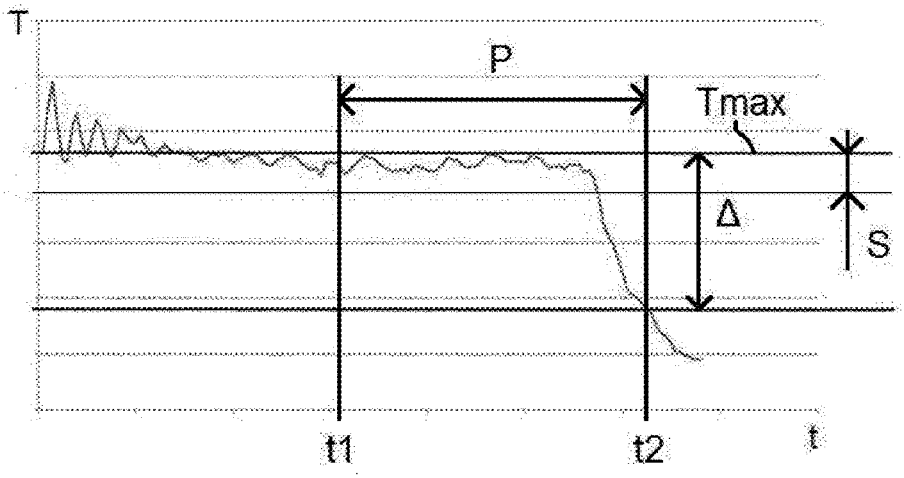
FIG. 5 is a graph showing the evolution of a parameter of an electric current traversing the electric motor of an electromechanical actuator of the motorized drive device as a function of time, when the configuration method, as shown in FIG. 4, is carried out.

In FIG. 5, the graph shows, by a curve using a solid line, the evolution of the voltage value T of the electric current traversing the electric motor 16, as a function of time t.

The time t is shown on the x-axis, and the voltage value T is shown on the y-axis.

In this embodiment, the configuration method of the motorized drive device 5 of the home-automation installation comprises a step E10 for entering the configuration mode of the motorized drive device 5.

The entry in the configuration mode of the motorized drive device 5 may be implemented by switching between the control mode and the configuration mode of the motorized drive device 5.

Advantageously, the electronic control unit 15 of the electromechanical actuator 11 is configured to switch from a control mode of the motorized drive device 5 to a configuration mode of the motorized drive device 5, and vice versa.

In one embodiment, the step E10 for entering the configuration mode of the motorized drive device 5 is carried out by pressing on the programming selection element of a control point 12, 14, in particular the remote control 14.

In another embodiment, the step E10 for entering the configuration mode of the motorized drive device 5 is carried out by simultaneously pressing on two selection elements of a control point 12, 14, in particular the remote control 14, for example the selection elements for raising and lowering the screen 2.

After the motorized drive device 5 has entered the configuration mode, the method comprises a step E20 for signaling the configuration mode.

In practice, the signaling step E20 is carried out by a movement of the screen 2 controlled by the motorized drive device 5.

Preferably, the movement of the screen 2 corresponds to a round-trip movement of the screen 2, in particular over a short distance that may for example be around one centimeter.

Here, the signaling step E20 is carried out after the step E10 for entering the configuration mode of the motorized drive device 5.

The configuration method comprises a step E30 for selecting a selection element of a control point 12, 14, in particular the remote control 14, for example the selection element for lowering the screen 2.

After step E30 for selecting a control point 12, 14, the configuration method comprises a first step E40 for moving the screen 2 toward the unwound position by activating the motorized drive device 5.

The configuration method comprises a step E50 for automatically determining a low end-of-travel position of the screen 2.

Thus, the step E50 for automatically determining the low end-of-travel position of the screen 2 makes it possible to define the movement travel of the screen 2 of the concealing device 3, during the lowering of the screen 2.

In this way, the first step E40 for moving the screen 2 toward the unwound position, or low position, is carried out until reaching a stop, as defined below by sub-step E530.

Preferably, step E50 for automatically determining the low end-of-travel position of the screen 2 is carried out after step E30 for selecting a selection element of a control point 12, 14, and in particular, during the first step E40 for moving the screen 2 toward the unwound position.

In one embodiment, the step E50 for automatically determining the low end-of-travel position of the screen 2 may also be associated with a step for automatically determining the high end-of-travel position of the screen 2.

The steps for automatically determining the low and high end-of-travel positions of the screen 2 can be carried out consecutively.

Advantageously, the step E50 for automatically determining the low end-of-travel position of the screen 2 comprises a sub-step E500 for measuring the parameter T of the electric current traversing the electric motor 16 using the measuring device 24 and a sub-step E530 for determining a variation Δ of the measured parameter T, as illustrated in FIG. 5.

Advantageously, the sub-step E500 for measuring the parameter T of the electric current is carried out periodically.

By way of non-limiting example, the sub-step E500 for measuring the parameter T of the electric current is carried out every 20 milliseconds.

The step E50 for automatically determining the low end-of-travel position of the screen 2 also comprises a sub-step E510 for storing values of the measured parameter T with a predetermined frequency.

Advantageously, the sub-step E510 for storing values of the measured parameter T is carried out according to the implementation frequency of the sub-step E500 for measuring the parameter T of the electric current.

The values of the measured parameter T, stored during the sub-step E510, are kept for a predetermined movement period P of the screen 2 toward the unwound position, during the first step E40 for moving the screen 2.

The step E50 for automatically determining the low end-of-travel position of the screen 2 also comprises a sub-step E520 for determining a maximum value Tmax of the measured parameter T from among the values of the measured parameter T, stored during sub-step E510, during the predetermined movement period P of the screen 2 toward the unwound position.

Advantageously, the values of the measured parameter T making it possible to determine the variation Δ of the measured parameter T are temporarily stored in a buffer memory of the electronic control unit 15, and in particular the microcontroller 27.

Preferably, the sub-step E530 for determining the variation Δ in the measured parameter T is carried out between a moment t1 preceding the determination of having reached the low end-of-travel position of the screen 2 and a moment t2 following the determination of having reached the low end-of-travel position of the screen 2, as illustrated in FIG. 5.

In practice, the sub-step E530 for determining the variation Δ of the measured parameter T is carried out using the electronic control unit 15, and in particular the measuring device 24 and a microcontroller of the electronic control unit 15.

Here, the sub-step E530 for determining the variation Δ of the measured parameter T is carried out after the execution of sub-steps E510 for storing the measured parameter T and E520 for determining the maximum value Tmax of the measured parameter T during the predetermined period P.

In one embodiment, the sub-step E530 for determining the variation Δ of the measured parameter T is carried out by determining a deviation between the maximum value Tmax of the measured parameter T during the predetermined period P and the last value of the measured parameter T during the predetermined period P.

Here, the sub-step E530 for determining the variation Δ of the measured parameter T corresponds to the detection of a deviation of the measured parameter T by the electronic control unit 15, in particular a deviation of the voltage across the terminals of a phase shift capacitor of the electric motor 16 of the electromechanical actuator 11.

The variation Δ of the measured parameter T is determined from the implementation of sub-step E500 for measuring the parameter T of the electric current according to a predetermined frequency, sub-step E510 for storing values of the measured parameter T according to the predetermined frequency and sub-step E520 for determining the maximum value Tmax of the measured parameter T during the predetermined period P.

Sub-step E530 for determining the variation Δ of the measured parameter T comprises comparing the maximum value Tmax of the measured parameter T during the predetermined period P with the last value of the measured parameter T during the predetermined period P and calculating the difference between the maximum value Tmax of the measured parameter T during the predetermined period P and the last value of the measured parameter T during the predetermined period P, so as to determine the variation Δ of the measured parameter T.

The different phases of sub-step E530 for determining the variation Δ of the measured parameter T are reiterated upon each new measurement of the parameter T of the electric current, in sub-step E500.

The step E50 for automatically determining the low end-of-travel position of the screen 2 is carried out until the variation Δ of the measured parameter T is determined.

The variation Δ of the determined measured parameter T, during sub-step E530, corresponds to the variation of the load at the electric motor 16 of the electromechanical actuator 11, when the load bar 8 of the screen 2 comes into contact with the threshold 7 of the opening 1, during the first step E40 for moving the screen 2.

In another embodiment, the sub-step E530 for determining the variation Δ of the measured parameter T is carried out by determining a deviation between a mean value of at least part of the values of the measured parameter T during the predetermined period P and the last value of the measured parameter T during the predetermined period P.

Advantageously, the step E50 for automatically determining the low end-of-travel position of the screen 2 comprises a sub-step E540 for storing the determined variation Δ of the measured parameter T, during sub-step E530.

The determined variation Δ of the measured parameter T is preferably recorded in a memory of a microcontroller of the electronic control unit 15.

The configuration method comprises, following the step E50 for automatically determining the low end-of-travel position of the screen 2, a step E60 for validating the low end-of-travel position of the screen 2.

Advantageously, the step E60 for validating the low end-of-travel position of the screen 2 is carried out when the determined variation Δ of the measured parameter T, during sub-step E530, is above a predetermined threshold value S.

As a non-limiting example, the predetermined threshold value S may be comprised in a range extending from 4 N·m to 6 N·m, N·m being the symbol for the unit of measure of a torque in Newton meters.

The predetermined threshold value S depends on the maximum value of the torque delivered by the electromechanical actuator 11.

In the case where the determined variation Δ of the measured parameter T, during sub-step E530, is above the predetermined threshold value S and the latter does not correspond to the actual low end-of-travel position of the screen 2, the steps E30 for selecting a selection element of the control point 12, 14, E40 for moving the screen 2 toward the unwound position and E50 for automatically determining the low end-of-travel position of the screen 2 are carried out again, so as to determine another variation Δ of the measured parameter.

Preferably, the step E60 for validating the determined low end-of-travel position of the screen 2, during step E50, comprises a sub-step E600 for keeping the motorized drive device 5 activated, so as to move the screen 2 toward the unwound position, during a predetermined period of time, not shown.

Thus, maintaining the activation of the motorized drive device 5 during the predetermined period of time, during sub-step E600, makes it possible to validate the low end-of-travel position of the screen 2 determined beforehand, during step E50, and in particular to validate the determined variation Δ of the measured parameter T, during sub-step E530.

In this way, maintaining the activation of the motorized drive device 5 during the predetermined period of time, during sub-step E600, makes it possible to validate that the determined variation Δ of the measured parameter T, during sub-step E530, does not correspond to the detection of a hard spot or a gust of wind, during the sliding of the screen 2 in the lateral guideways 6, during the first step E40 for moving the screen 2 toward the unwound position by activating the motorized drive device 5.

During the step E60 for validating the low end-of-travel position of the screen 2, the first step E40 for moving the screen 2 by activating the motorized drive device 5 continues to be carried out, such that the screen 2 continues to unwind even though the load bar 8 of the screen 2 is resting on the threshold 7 of the opening 1.

Thus, after step E60 for validating the determined low end-of-travel position, the screen 2 is relaxed.

As one non-limiting example, the predetermined period of time during which the motorized drive device 5 is kept activated is about 400 milliseconds.

Here, the determined low end-of-travel position of the screen 2, during step E50, is validated, during step E60, if the parameter T measured after the determination of the low end-of-travel position of the screen 2 is stable.

In practice, the low end-of-travel position of the screen 2 is validated when the parameter T measured during the predetermined period of time, of sub-step E600, is comprised between two threshold values $T_1$, $T_2$ determined from the last value of the parameter T measured and stored, to determine the variation Δ of the measured parameter T, during the sub-step E530.

Step E60 for validating the determined low end-of-travel position of the screen 2 comprises a sub-step E610 for measuring the parameter T of the electric current traversing the electric motor 16, a sub-step E620 for comparing the measured parameter T after the determination of the low end-of-travel position of the screen 2, during step E50, with the parameter T measured during the predetermined period of time, during sub-step E600.

In practice, the step E60 for validating the low end-of-travel position of the screen 2 is carried out using the electronic control unit 15, and in particular the measuring device 24 and a microcontroller of the electronic control unit 15.

The configuration method comprises a step E70 for stopping the motorized drive device 5, after validating the low end-of-travel position of the screen 2, during step E60.

Here, the step E70 for stopping the motorized drive device 5 is carried out after the predetermined period of time has elapsed, of sub-step E600.

In practice, when the determined variation Δ of the measured parameter T, during sub-step E530, is above the predetermined threshold value S, then validated during step E60 for validating the determined low end-of-travel position of the screen 2, step E70 for stopping the motorized drive device 5 is carried out.

The configuration method comprises, after step E70 for stopping the motorized drive device 5, a step E80 for moving the screen 2 toward the wound position by activating the motorized drive device 5, then a step E90 for stopping the motorized drive device 5.

In practice, the step E80 for moving the screen 2 toward the wound position by activating the motorized drive device 5 is carried out during the predetermined period of time or during at least a predetermined portion of a revolution of the output shaft 20 of the electromechanical actuator 11.

The step E80 for moving the screen 2 toward the wound position by activating the motorized drive device 5 makes it possible to stretch the screen 2 again.

The configuration method also comprises a second step E100 for moving the screen 2 toward the unwound position by activating the motorized drive device 5, and a step E110 for stopping the motorized drive device 5 in the determined low end-of-travel position of the screen 2, during step E50.

Thus, the method for configuring the motorized drive device 5 makes it possible, in the configuration mode of the motorized drive device 5, to learn the low end-of-travel position of the screen 2 following a downward movement of the screen 2, like upon reaching the low end-of-travel position of the screen 2 in the control mode of the motorized drive device 5, so as to minimize the distance between the learning position defined in the configuration mode and the low end-of-travel position of the screen 2 reached in the control mode.

In this way, the method for configuring the motorized drive device 5 makes it possible to improve the learning precision of the low end-of-travel position of the screen 2.

Furthermore, such a method for configuring the motorized drive device 5 makes it possible to eliminate the verification by the installer of the low end-of-travel position of the screen 2 reached in the control mode relative to the learning position defined in the configuration mode.

After the second step E100 for moving the screen 2 toward the unwound position by activating the motorized drive device 5, the motorized drive device 5 is stopped in the determined low end-of-travel position of the screen 2, during step E50, and more particularly, in the position of the screen 2 corresponding to the determination of the variation Δ of the measured parameter T, during sub-step E530, during the first step E40 for moving the screen 2 toward the unwound position by activating the motorized drive device 5.

In this way, during the stop, in step E110, of the motorized drive device 5 in the determined low end-of-travel position of the screen 2, during step E50, the screen 2 is kept stretched in the lateral guideways 6 and the distance between the load bar 8 of the screen 2 and the threshold 7 of the opening 1 is minimized.

Furthermore, after step E110 for stopping the motorized drive device 5 in the determined low end-of-travel position of the screen 2, during step E50, this position of the screen 2, which can be viewed by the installer in the configuration mode of the motorized drive device 5, corresponds to the low end-of-travel position of the screen 2 reached after a downward movement of the screen 2 in the unwound position, in the control mode of the motorized drive device 5.

Advantageously, the step E50 for automatically determining the low end-of-travel position of the screen 2 comprises a sub-step E550 for storing the low end-of-travel position of the screen 2.

Thus, after the second step E100 for moving the screen 2 toward the unwound position, the screen 2 is stopped, during step E110, in the stored low end-of-travel position of the screen 2, during sub-step E550.

In practice, the sub-step E550 for storing the low end-of-travel position of the screen 2 is carried out using the electronic control unit 15, and in particular a memory of a microcontroller of the electronic control unit 15.

Furthermore, the sub-step E550 for storing the low end-of-travel position of the screen 2 is carried out by the electronic control unit 15, and in particular by a memory of a microcontroller of the electronic control unit 15, and a counting means configured to determine the position of the load bar 8 of the screen 2 between the wound position and the unwound position.

In one example embodiment, the counting means for the position of the load bar 8 of the screen 2 between the wound position and the unwound position is implemented using a coding wheel driven by the winding tube 4, the coding wheel being able to comprise at least one magnet cooperating with at least one Hall effect sensor.

In another example embodiment, the counting means for the position of the load bar 8 of the screen 2 between the wound position and the unwound position is implemented using one or several senses detecting the rotation of the rotor of the electric motor 16 of the electrochemical actuator 11.

In another example embodiment, the counting means for the position of the load bar 8 of the screen 2 between the wound position and the unwound position is implemented using an internal counting element of a microcontroller of the electronic control unit 15, or a counting element associated with a clock of the electronic control unit 15.

The position of the screen 2 determined during step E50 and stored during sub-step E550 corresponds to the low end-of-travel learning position of the screen 2. The low end-of-travel learning position of the screen 2 is the position of the screen 2 corresponding to the moment of the determination of the variation Δ of the measured parameter T, during sub-step E530, in other words at the moment where the load bar 8 of the screen 2 touches the threshold 7 of the opening 1, during step E40 for moving the screen 2 toward the unwound position.

The low end-of-travel learning position of the screen 2 is used during a movement of the screen 2 toward the unwound position in the control mode of the motorized drive device 5, so as to stop the screen 2 in the low end-of-travel position of the screen 2 and to keep the screen 2 stretched in the lateral guideways 6 and as close as possible to the threshold 7 of the opening 1.

In one embodiment, the configuration method comprises, following the step E110 for stopping the motorized drive device 5 in the determined low end-of-travel position of the screen 2, a step E120 for confirming the low end-of-travel position of the screen 2.

The step E120 for confirming the low end-of-travel position of the screen 2 is carried out by the user.

In one embodiment, the step E120 for confirming the low end-of-travel position of the screen 2 is carried out by pressing on a selection element of a control point 12, 14, in particular the remote control 14.

As a non-limiting example, the step E120 for confirming the low end-of-travel position of the screen 2 is carried out by pressing on the selection element of the control point 12, 14 corresponding to stopping of the movement of the screen 2.

Furthermore, the step E120 for confirming the low end-of-travel position of the screen 2 is carried out by pressing on a selection element of a control point 12, 14 during a predetermined period of time.

As a non-limiting example, the predetermined time period during which the pressing on a selection element of a control point 12, 14 is done to confirm the low end-of-travel position of the screen 2 is approximately two seconds.

Here, the steps E70, E90, E110 for stopping the motorized drive device 5 are carried out automatically by the electronic control unit 15 of the electromechanical actuator 11.

Likewise, the steps E80, E100 for moving the screen 2 by activating the motorized drive device 5 are carried out automatically by the electronic control unit 15 of the electromechanical actuator 11.

Furthermore, the steps E40, E80, E100 for moving the screen 2 by activating the motorized drive device 5 are carried out in the configuration mode of the motorized drive device 5.

Such a configuration method, in which the learning of the low end-of-travel position of the screen 2 is implemented using software via the electronic control unit 15 of the electrochemical actuator 11, makes it possible to minimize the costs of obtaining the motorized drive device 5.

Owing to the present invention, the method for configuring the motorized drive device of the closure or sun-protection home-automation installation makes it possible, in the configuration mode of the motorized drive device, to learn the low end-of-travel position of the screen following a downward movement of the screen, like upon reaching the low end-of-travel position of the screen in a control mode of the motorized drive device, so as to minimize the distance between the learning position defined in the configuration mode and the low end-of-travel position of the screen reached in the control mode.

In this way, the method for configuring the motorized drive device for the closure or sun-protection home-automation installation makes it possible to improve the learning precision of the low end-of-travel position of the screen.

In practice, a data recording medium, readable by a computer, is integrated into the home-automation installation and serves to store a computer program comprising codes to carry out the steps E10 to E120 of the configuration method described above. The invention also relates to this data recording medium and this computer program.

Of course, many changes can be made to the example embodiments previously described without going beyond the scope of the invention defined by the claims.

In particular, the electric motor of the electromechanical actuator can be of the asynchronous type, DC type, or of the brushless DC type with electronic switching, also called "BLDC" (BrushLess Direct Current) or synchronous with permanent magnets.

Furthermore, the measured parameter T of the electric current traversing the electric motor 16 can be different from its voltage. It may in particular involve its intensity.

Furthermore, the considered embodiments and alternatives may be combined to generate new embodiments of the invention.

The invention claimed is:

1. A method for configuring a motorized drive device for a closure or sun-protection home-automation installation, wherein the closure or sun-protection home-automation installation comprises a concealing device, the concealing device comprises at least:

a winding tube, a screen, a first end of the screen being fastened to the winding tube, and a load bar, a second end of the screen being fastened to the load bar, and the motorized drive device comprises at least:

an electromechanical actuator configured to wind and unwind the screen on the winding tube between a wound position and an unwound position, the electromechanical actuator having at least an electric motor, an output shaft connected to the winding tube of the concealing device, and an electronic control unit that includes a device for measuring a parameter of an electric current traversing the electric motor and a memory storing a value of the measured parameter, said method comprising entering a configuration mode of the motorized drive device ;

first movement of the screen toward the unwound position by activating the motorized drive device;

automatically determining a low end-of-travel position of the screen;

moving the screen toward the wound position by activating the motorized drive device;

second movement of the screen toward the unwound position by activating the motorized drive device; and stopping the motorized drive device in the determined low end-of-travel position of the screen, during the automatic determination step, wherein the step of automatically determining the low end-of-travel position of the screen includes a sub-step of measuring the parameter of the electric current traversing the electric motor using the measuring device, and a sub-step of determining a variation of the measured parameter among a plurality of measured values of the measured parameter, these values being obtained by the device for measuring.

2. The method according to claim 1, further comprising:

following the step for automatically determining the low end-of-travel position of the screen, a step for validating the low end-of-travel position of the screen.

3. The method according to claim 2, wherein the step for validating the low end-of-travel position of the screen is carried out when the determined variation of the measured parameter, during sub-step, is above a predetermined threshold value.

4. The method according to claim 2, wherein the step for validating the low end-of-travel position of the screen comprises a sub-step for maintaining the activation of the motorized drive device, so as to move the screen toward the unwound position, during a predetermined period of time.

5. The method according to claim 1, wherein the step for moving the screen toward the wound position by activating the motorized drive device is carried out during a predetermined period of time or during at least a predetermined portion of a revolution of the output shaft of the electromechanical actuator.

6. The method according to claim 1, wherein the step for automatically determining the low end-of-travel position of the screen comprises a sub-step for storing the low end-of-travel position of the screen.

7. The method according to claim 1, further comprising: following the step for stopping the motorized drive device in the determined low end-of-travel position of the screen, a step for confirming the low end-of-travel position of the screen.

8. A motorized drive device for a closure or sun-protection home-automation installation, wherein an electronic control unit of an electromechanical actuator of the motorized drive device is configured to carry out the configuration method according to claim 1.

9. A closure or sun-protection home-automation installation, wherein said home-automation installation comprises a motorized drive device according to claim 8.

* * * * *